United States Patent [19]

Stumpp

[11] Patent Number: 5,036,808

[45] Date of Patent: Aug. 6, 1991

[54] DIESEL-INTERNAL-COMBUSTION-ENGINE, IN PARTICULAR FOR VEHICLES

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 423,412

[22] PCT Filed: Nov. 25, 1988

[86] PCT No.: PCT/DE88/00733

§ 371 Date: Sep. 28, 1989

§ 102(e) Date: Sep. 28, 1989

[87] PCT Pub. No.: WO89/05395

PCT Pub. Date: Jun. 15, 1989

[30] Foreign Application Priority Data

Dec. 2, 1987 [DE] Fed. Rep. of Germany ..... 3740803

[51] Int. Cl.[5] ..... F02B 77/00

[52] U.S. Cl. ..... 123/198 D; 123/378

[58] Field of Search ..... 123/198 D, 319, 376, 123/378, 397, 401

[56] References Cited

U.S. PATENT DOCUMENTS

| | | | |
|---|---|---|---|
| 4,375,748 | 3/1983 | Yamane | 123/378 |
| 4,393,833 | 7/1983 | Mann et al. | 123/397 |
| 4,401,078 | 8/1983 | Kato et al. | 123/378 |
| 4,426,972 | 1/1984 | Kimura et al. | 123/378 |

FOREIGN PATENT DOCUMENTS 3304335 8/1984 Fed. Rep. of Germany .

*Primary Examiner*—Noah P. Kamen

*Attorney, Agent, or Firm*—Michael J. Striker

[57] ABSTRACT

In a diesel internal combustion engine comprising an air intake pipe and a throttle valve arranged in the latter, the throttle valve is equipped with a drive in order to prevent operating states which are dangerous for the internal combustion engine, e.g. uncontrolled exceeding of the allowable maximum speed due to disturbances. The drive holds the throttle valve open during trouble-free operation and moves it into a closed position during disturbances. The closed position of the throttle valve is determined in such a way that the remaining reduced air flow cross-section throttles the combustion air passing through to such an extent that the internal combustion engine still runs securely at idling speed and does not exceed a predetermined speed during feeding of a desired quantity of fuel.

8 Claims, 1 Drawing Sheet

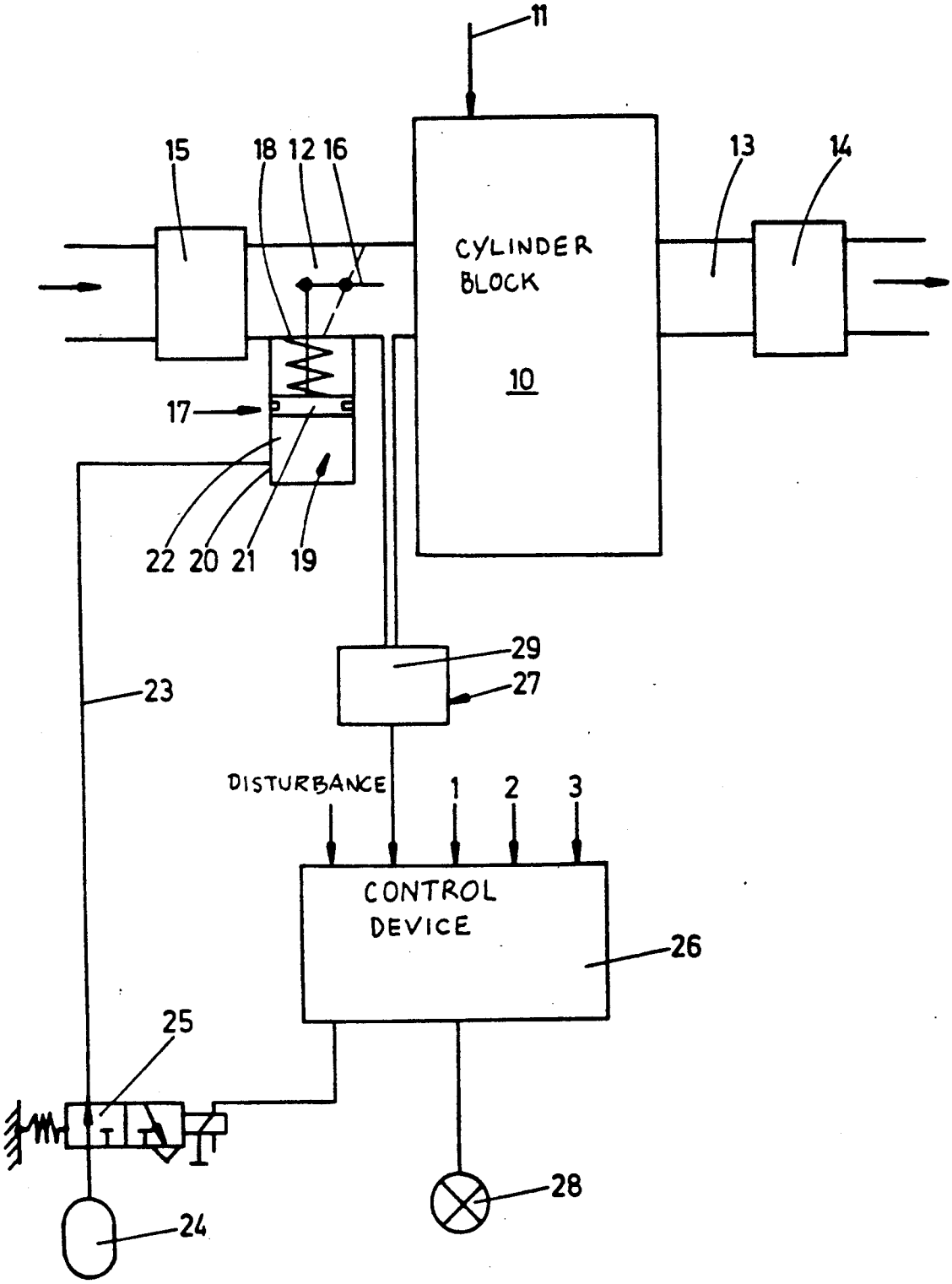
11
15
18
12
16
13
14
CYLINDER BLOCK
10
17
22
20
21
19
29
27
23
DISTURBANCE
1
2
3
CONTROL DEVICE
26
25
28
24

DIESEL-INTERNAL-COMBUSTION-ENGINE, IN PARTICULAR FOR VEHICLES

BACKGROUND OF THE INVENTION

The invention is directed to a diesel internal combustion engine, particularly for vehicles and comprising an air intake pipe for supplying air of combustion to combustion cylinders and a throttle valve located in the air intake pipe and pivotable therein for controlling a flow cross-section.

In such diesel internal combustion engines for vehicles, a dangerous operating state can occur if more combustible fuel-air mixture is supplied than was selected by the driver per actuation of the accelerator pedal due to disturbances in the combustion cylinders. Damages to the internal combustion engine can occur by exceeding the allowable maximum speed, or accidents can occur because it is not possible to "ease up on the gas" ("automatic acceleration").

It is already known for diesel engines with fuel injection pumps to stop the fuel supply to the fuel injection pump in such cases by an emergency stopping device, so that the engine stops after the pump interior space is sucked empty by the fuel injection pump (DE-OS 30 04 335). In fuel injection pumps with a large pump interior, the reaction time, i.e. the time between the occurrence of disturbance until the stopping of the engine, is relatively long. The emptying of the pump interior can be accelerated and the reaction time of the emergency stopping device can accordingly be shortened by additional measures.

SUMMARY OF THE INVENTION

The object of the present invention is a diesel internal combustion engine that does not turn off when an excessive unwanted amount of fuel is supplied, rather only the speed is limited. The object of the invention is achieved by providing a drive for pivoting the throttle valve and a control mechanism for controlling operation of the drive in accordance with existing operational conditions. The safety device required for this purpose is very simple with respect to construction and can be realized with simple means. In addition, its functioning can be checked continuously or from time to time during the operation of the engine, specifically in an idle state so a higher degree of safety is provided. The safety device, according to the invention, is characterized by an extremely short reaction time.

According to an advantageous embodiment of the invention, the drive comprises a drive spring acting in the closing direction of the throttle valve, and an electric, pneumatic or hydraulic motor acting in the opening direction of the throttle valve. Thereby a safe operating state of the internal combustion engine is always achieved without auxiliary energy. A defect in the safety device allows the safe operating state of the internal combustion engine to occur automatically.

The functioning of the safety device can be checked without impeding the driving operation and so as to be unnoticed by the driver by a monitoring device provided according to another embodiment of the invention which, when switched on, sends a closing signal for the valve drive, i.e. a turn-off signal for the motor in the construction of the valve drive as indicated above, when absolute idling conditions, such as idling speed of the internal combustion engine, idling position of the accelerator, idling fuel injection quantity supplied to the combustion cylinders, prevail when the internal combustion engine is at operating temperature. In the event that the throttle valve does not occupy its preselected closing position under idling conditions and transmission of the closing signal for the throttle valve drive, a warning light is switched on which reports a failure of the safety device to the driver and induces him to search for a workshop. It is sufficient if the function testing of the safety device is carried out by the monitoring unit once every time the internal combustion engine is restarted when the internal combustion engine is at an operating temperature. A continuous checking in every idling phase of the internal combustion engine is also possible.

The sensor required for the monitoring device for detecting the closing position of the throttle valve can be constructed in various ways. As pressure sensor, it detects the closing position of the throttle valve when the pressure downstream of the throttle valve decreases to a given value. As air quantity gauge, it will signal the closing position of the throttle valve when the air quantity per time unit measured downstream of the throttle valve, decreases below a limiting value. As lambda probe in the exhaust flow, it can detect the closing position of the throttle when the $\lambda$ value falls below a limiting value. When the sensor is constructed as an exhaust temperature sensor, it can detect the closing position of the throttle when the exhaust temperature exceeds a preselected limiting value. Finally, the sensor can also be constructed as a simple electric switch which is actuated by the throttle valve in its closing position.

According to a preferred embodiment of the invention, the throttle valve is arranged as close as possible to the inlet valves of the combustion cylinders, specifically downstream of a crankcase breather, so that the air volume between the throttle valve and the inlet valves is as small as possible and so that very short reaction times can be achieved.

In diesel engines with turbochargers, the throttle valve is to be arranged downstream of the air compressor of the turbocharger.

The present invention both as to its construction so to its mode of operation, together with additional objects and advantages thereof, will be best understood from the following detailed description of a specific embodiment when read in connection with the accompanying drawing.

DESCRIPTION OF THE DRAWINGS

The single Figure of the drawings shows a schematic view of a diesel internal combustion engine with a safety device according to the present invention.

DESCRIPTION OF THE PREFERRED EMBODIMENT

In the diesel internal combustion engine shown schematically in FIG. 1, the cylinder block in which the combustion cylinders are comprised is designated by 10. Fuel is preferably supplied to the combustion cylinders by a fuel injection pump an arrow 11. The air required for the combustion of the fuel arrives in the combustion cylinders via the inlet valves, not shown. The air is supplied to the inlet valves through an air intake pipe 12. The exhaust gases discharged by the combustion cylinders are blown out into the environment via an exhaust manifold. In diesel internal combustion engines with turbochargers, the drive turbine 14 of the turbocharger is arranged in the exhaust manifold 13, while the air compressor 15 which, is rigidly coupled with the drive turbine 14 is arranged in the air intake pipe 12.

A throttle valve 16, which can be moved by a valve drive 17 from a closed position indicated in dashed lines, an open position shown in solid lines, and vice versa, is held so as to be swivelable in the air intake pipe 12 downstream of the air compressor 15 so as to be arranged directly in front of the inlet valves of the combustion cylinders. In the open position, the throttle valve 16 provides a full air passage cross section of the air intake pipe 12, which is reduced in the closed position to a cross-section in which the combustion air passing through the remaining air gap, is throttled to the extent that the internal combustion engine still runs in a secure manner at idling speed, on one hand, and does not exceed a preselected speed during the supply of a desired fuel quantity to the combustion cylinders, on the other hand.

The valve drive 17 comprises a drive spring 18 acting in the closing direction of the throttle valve 16, and of a pneumatic motor 19 acting in the opening direction of the throttle valve 16. Such a motor 19 may comprise e.g., a diaphragm drive with a diaphragm which is acted upon by pressure or a working cylinder 20 with a working piston 21 which is guided axially therein, which are connected with the throttle valve 16. Working cylinder 20 and working piston 21 define a work chamber 22 which is connected A compressed air control valve, preferably a 3/2-directional control magnet valve 25, is arranged in the compressed air line 23 for aerating and de-aerating the work chamber 22. The magnet valve 25 is controlled by a control mechanism which is combined with a monitoring unit, explained in more detail, below to form a control device 26. A hydraulic motor or an electric motor can also be used.

The throttle valve 16, the valve drive 17 and the control mechanism of the control device 26 form a safety device which ensures that no more combustible fuel-air mixture is supplied to the combustion cylinders due to a disturbance than is preselected by the driver per accelerator pedal actuation. The occurrence of a dangerous state for the internal combustion engine, such as exceeding the maximum speed, is accordingly prevented. In particular, the safety device operates as follows. During regular operation of the internal combustion engine, the throttle valve 16 occupies its open position shown in the drawing, since the magnetic valve 25 which is supplied with current connects the work chamber 22 of the pneumatic motor 19 with the compressed air storage 24. If trouble occurs, e.g. jamming of the control rod of the fuel injection pump, which leads to an unwanted and uncontrolled increase in speed of the internal combustion engine, the trouble is detected and a trouble signal is fed to the control mechanism in the control device 26. Such a trouble signal can be determined e.g. from a persistent regulating deviation between the calculated reference injection quantity and the actual injection quantity, as described in the DE-OS 33 04 335. The magnet valve 25 is switched to the currentless state via the control device 26 at the occurrence of the trouble signal. The magnet valve 25 switches into its working position in which the work chamber 22 of the pneumatic motor 19 is de-aerated. The pre-stressed closing spring 18 of the valve drive 17 moves the working piston 21 downward with reference to the plane of the drawing, so that the throttle valve 16 is transferred into its closed position shown, in dashes in the drawing. In this closed position, the air of combustion arriving in the combustion cylinders via the inlet valves is throttled until a predetermined speed is not exceeded during the supply of a desired amount of fuel to the combustion cylinders. However, enough air of combustion is supplied at the same time so that the internal combustion engine still securely rotates at its idling speed. As soon as the disturbance is eliminated and the trouble signal goes away, the magnet valve 25 returns to its initial position after the exciting winding is provided with current, and connects the work chamber 22 with the compressed air storage 24. The compressed air flowing into the work chamber 22 displaces the work piston 21 upward with, reference to the drawing plane accompanied by stressing of the closing spring 18, and the work piston 21 swivels the throttle valve 16 into its open position.

For the purpose of monitoring the functioning of the safety device, a monitoring unit is integrated in the control device 26. This monitoring unit sends a closing signal to the valve drive 17 when the accelerator pedal is in the idling position when the internal combustion engine is at operating temperature and running at idling speed, and the fuel quantity supplied to the combustion cylinders corresponds to the idling fuel injection quantity. The closed position of the throttle valve 16 is detected by a sensor 27 and fed to the control device 26. If no sensor signal reporting the closed position of the throttle valve 16 occurs when a closing signal is sent, the monitoring unit switches on a warning light 28 which reports the functioning disturbance of the safety device to the driver. The activation of the monitoring unit is effected only once each time the internal combustion engine is restarted.

In order to carry out this monitoring function, three signal lines 1, 2 and 3 are connected to the control device 26. The position of the accelerator pedal is transmitted to the control device 26 via the signal line 1. The signal line 2 is connected with a speed transmitter which supplies a signal proportional to the speed of the internal combustion engine. The signal line 3 is connected with a temperature gauge which measures the temperature of the cylinder block 10 and transmits it as an electric signal. The sensor 27 sensing the closed position of the throttle valve 16, is constructed in the embodiment shown in the drawing as a pressure gauge 28 which measures the charging pressure in the air intake pipe !2 downstream of the throttle valve 16. An electric signal which is proportional to the pressure is fed to the control device 26 and is compared with a preselected value. If the signal falls below the preselected value, the safety device is detected as operational. In the other case, the warning light 28 is switched on.

The sensor 27 can also be constructed as an air quantity gauge which measures the air quantity which passes through the air flow cross section released by the throttle valve 16. As another possibility, a lambda probe arranged in the exhaust manifold 13 or an exhaust temperature probe can be used as a sensor; if the $\lambda$ value falls below or the exhaust temperature exceeds a limiting value, this indicates the closing position of the throttle valve 16. In the simplest embodiment, the sensor 27 can be constructed as an electric switch which is actuated by the throttle valve 16 in its closing position and supplies a signal to the control device 26 when closing.

The invention is not limited to the described embodiment. Thus, the motor component of the valve drive 17 can be constructed not only as pneumatic means, but also as hydraulic or electric.

While the invention has been illustrated and described as embodied in a diesel internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A diesel internal combustion engine comprising a plurality of combustion cylinders; an air intake pipe for supplying air of combustion to said combustion cylinders; a throttle valve pivotably arranged in said air intake pipe for determining an air flow cross-section of said intake pipe; drive means for moving said throttle valve between an open position in which the air of combustion flows through a full air flow cross-section of said air intake pipe, and a closed position in which an air flow cross-section of said air intake pipe is reduced; control means for actuating said drive means to cause movement of said throttle valve to the open position thereof at trouble-free operation of said diesel internal combustion engine, and to cause movement of said throttle valve to the closed position thereof upon occurrence of disturbances in the trouble-free operation of said diesel internal combustion engine, the reduced air flow cross-section of said air intake pipe in the closed position of said throttle valve being so selected that an air quantity that flows through the reduced air flow cross-section insures running of said internal combustion engine at an idling speed and prevents a predetermined speed of said internal combustion engine from being exceeded even if a supplied fuel quantity exceeds a predetermined fuel quantity required for running said internal combustion engine with the predetermined speed; and means for monitoring operation of said throttle valve and said drive means during an idling operation of said diesel internal combustion engine, said monitoring means transmitting a closing signal to said drive means in an idling position of an accelerator pedal of a vehicle during the idling operation of said internal combustion engine at an operating temperature and when a fuel quantity fed to said combustion cylinders corresponds to a fuel quantity required for the idling operation, said diesel internal combustion engine further comprising a sensor for sensing the closed position of said throttle valve.

2. A diesel internal combustion engine as set forth in claim 1, wherein said sensor directs an output signal to said monitoring means, said monitoring means generating a warning signal when the output signal of said senor is not indicative of the closed position of said throttle valve.

3. A diesel internal combustion engine as set forth in claim 1, wherein said sensor comprises a pressure sensor for measuring said air pressure in said air intake pipe downstream of said throttle valve.

4. A diesel internal combustion engine as set forth in claim 1, wherein said sensor comprises an air flow meter for measuring an air quantity flowing through said air intake pipe in an operational position of said throttle valve.

5. A diesel internal combustion engine as set forth in claim 1, wherein said sensor comprises a lambda probe located in an exhaust of said internal combustion engine.

6. A diesel internal combustion engine as set forth in claim 1, wherein said sensor comprises an exhaust temperature gauge.

7. A diesel internal combustion engine as set forth in claim 1, wherein said sensor comprises an electric switch actuated by said throttle valve in the closed position thereof.

8. A diesel internal combustion engine comprising a plurality of combustion cylinders; an air intake pipe for supplying air of combustion to said combustion cylinders; a throttle valve pivotably arranged in said air intake pipe for determining an air flow cross-section of said intake pipe; drive means for moving said throttle valve between an open position in which the air of combustion flows through a full air flow cross-section of said air intake pipe, and a closed position in which an air flow cross-section of said air intake pipe is reduced; control means for actuating said drive means to cause movement of said throttle valve to the open position thereof at trouble-free operation of said diesel internal combustion engine, and to cause movement of said throttle valve to the closed position thereof upon occurrence of disturbances in the trouble-free operation of said diesel internal combustion engine, the reduced air flow cross-section of said air intake pipe in the closed position of said throttle valve being so selected that an air quantity that flows through the reduced air flow cross-section insures running of said internal combustion engine at an idling speed and prevents a predetermined speed of said internal combustion engine from being exceeded even if a supplied fuel quantity exceeds a predetermined fuel quantity required for running said internal combustion engine with the predetermined speed; and means for monitoring operation of said throttle valve and said drive means during an idling operation of said diesel internal combustion engine, said monitoring means being actuated only once after every starting of said diesel internal combustion engine.

* * * * *